US007648404B1

(12) United States Patent
Martin

(10) Patent No.: US 7,648,404 B1
(45) Date of Patent: Jan. 19, 2010

(54) ADJUSTABLE FOOT STRAP AND SPORTS BOARD

(76) Inventor: John Dietrich Martin, 10308 SW. 116th St., Vashon Island, WA (US) 98070

( * ) Notice: Subject to any disclaimer, the term of this patent is extended or adjusted under 35 U.S.C. 154(b) by 292 days.

(21) Appl. No.: 11/748,648

(22) Filed: May 15, 2007

(51) Int. Cl.
*B63B 35/85* (2006.01)

(52) U.S. Cl. ..... 441/70; 114/39.19

(58) Field of Classification Search ..... 114/39.19; 441/70; 24/68 SK, 68 B; 280/621, 622; 36/50.1, 50.5, 53, 54, 56
See application file for complete search history.

(56) References Cited

U.S. PATENT DOCUMENTS 4,748,726 A * 6/1988 Schoch ..... 24/68 SK
4,969,655 A * 11/1990 Katz ..... 280/14.22
6,336,418 B1 * 1/2002 Pavlovic ..... 114/39.19
2003/0093882 A1 * 5/2003 Gorza et al. ..... 24/68 SK

* cited by examiner

*Primary Examiner*—Ed Swinehart
(74) *Attorney, Agent, or Firm*—David L. Tingey

(57) ABSTRACT

A foot strap and recreational sports board that allows the user to easily tension a foot strap over the top of his or her foot. The foot strap, attached to the board, includes a strap, a cable, and a cable adjuster. The strap has separate first and second sides connected by the cable cinched and uncinched together as the cable is tightened and loosened by the cable adjuster with which it is engaged. A single cable adjuster and cable can be employed to simultaneously adjust two straps, both attached to the sports board. A pull may be included to facilitate exercise of the cable adjuster.

4 Claims, 7 Drawing Sheets

ADJUSTABLE FOOT STRAP AND SPORTS BOARD

PRIORITY CLAIM

Applicant claims priority from provisional application Ser. Nos. 60/515,305 and 60/552,218 and prior nonprovisional application filed Nov. 26, 2004 and assigned Ser. No. 10/903,491.

FIELD OF THE INVENTION

This invention relates generally to foot securement straps for sports boards and, more specifically, to adjustment mechanisms for sports board bindings.

BACKGROUND OF THE INVENTION

A typical foot strap binding for a kite board or windsurf board is constructed of a webbing strap or a molded strap with a soft pad or cushion as an enclosure to hold a person's foot securely without digging in or otherwise causing pain or discomfort. The size of the strap can be adjusted by removing the strap mounting screws, readjusting the overall length and position of the strap and re-attaching the strap to the board using different board attachment positions.

Adjustment on the strap binding is difficult to do or impractical when the board is in use. This process usually must be done on land with hand tools. Quick adjustments or fine tuning are not possible. Each time the user needs to make an adjustment, he or she must stop, or go to shore (water sports) to properly make this adjustment. A typical problem occurs when a user changes his or her foot volume by adding a water boot or shoe. Also if riders with different foot volumes use the same foot strap such as for boards used by an instruction school where several riders use the same board or in a rental scenario—they would need to make this volume adjustment. The most common problem of a typical foot strap is the need to keep the binding loose somewhat to get the foot in and out of the binding easily. The user is not able to quickly tighten beyond what is typical for entry/exit for good performance hold, but still quickly and easily release when needed.

Some foot straps are secured with hook-and-loop fasteners (e.g., Velcro™). However, the user must still be on land to properly adjust because the Velcro strap must be completely disengaged to reset the straps. Furthermore, Velcro tends to decrease in effectiveness when used in a dirty environment such as may be found on a beach or shore. Small changes due to riding the board may lose an effective hold over time.

Attempts have been made to solve these problems, but attempts to solve these problems do not achieve the ease of use or the effective tightening desired.

SUMMARY OF THE INVENTION

The present invention provides a foot strap assembly for board sports such as water sports that allows the user to easily tension a foot strap over the top of his or her foot. The foot strap device includes a strap, a cable, and an cable adjuster. The strap has separate first and second sides connected by the cable. The cable is tightened and loosened by the cable adjuster with which it is engaged. For these purposes, the cable is representative of all tension members, including but not limited to cables, laces, ropes, strings, cords, etc., all of which are deemed to be included in the use of the term "cable."

A pad is secured between the strap first side and the foot of the user. An enclosure sheath is also preferably positioned over at least a portion of the cable and the strap with the cable adjuster having access through the sheath. The pad is preferably made of EVA (ethyl vinyl acetate), but may alternatively be any soft, durable, resilient pad.

The cable adjuster includes a rotatable reel about which the cable winds in adjusting tension in the cable. A first guide is secured to the first side of the strap and a second guide is secured to the strap second side, which channels the cable between the strap sides and into a loop to and from the cable adjuster.

The cable adjuster may also include a pull cord with a handle, which pull cord is coupled to rotate the reel.

The second side of the strap slides into a sleeve that is typically secured to the pad though equivalently it could be secured to the first side of the strap with a same affect. For these purposes, description of one configuration is deemed to include the other. Tensioning of the cable with the cable adjuster pulls the first and second strap sides together as the second side telescopes into (or out of when the tension is released on the cable) which moves the pad along the enclosure. Of necessity then the strap first and second sides overlap as the second side telescopes into the sleeve attached to the pad. For purposes herein, we refer to all manner of the strap bodies sliding together as mutually telescoping, or similar term, but such reference is deemed to include all such other ways of doing so in addition to telescoping. In practice then, the cable is tensioned to bring the straps together which shortens the effective length of the strap. In doing so, the strap maintains a continuous enclosure arched over the board together with the board under the strap into which the user's foot may be inserted. As the effective length of the strap is adjusted to resize the enclosure by tensioning or releasing tension of the cable between the sides of the strap, the enclosure maintains an uninterrupted cover over the foot comfortable to the user's foot.

Employment of the strap also permits positioning of the cable adjuster between strap first and second sides at any convenient position, including remote from the strap or to either a medial or a lateral side of the strap. Thus, in one embodiment, the strap is secured to the sports board and the cable adjuster is also secured to the sports board instead of to the strap. In this embodiment, a first strap secures a first foot of the user and a second strap secures a second foot of the user. With the cable coupled through the cable adjuster and between the first and the second straps, the cable adjuster selectively tightens or loosens the tension on both the first and second straps simultaneously. For all purposes herein, the term sports board refers to and includes all recreational boards on which a user rides while standing on the board, including as illustrative but not limited to snowboards, kite-boards, windsurf boards, ocean surf boards, and the like.

The strap is preferably constructed of a molded plastic material. Alternatively, strap is constructed of metal, composites, or other material that can bear tensile forces.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1:
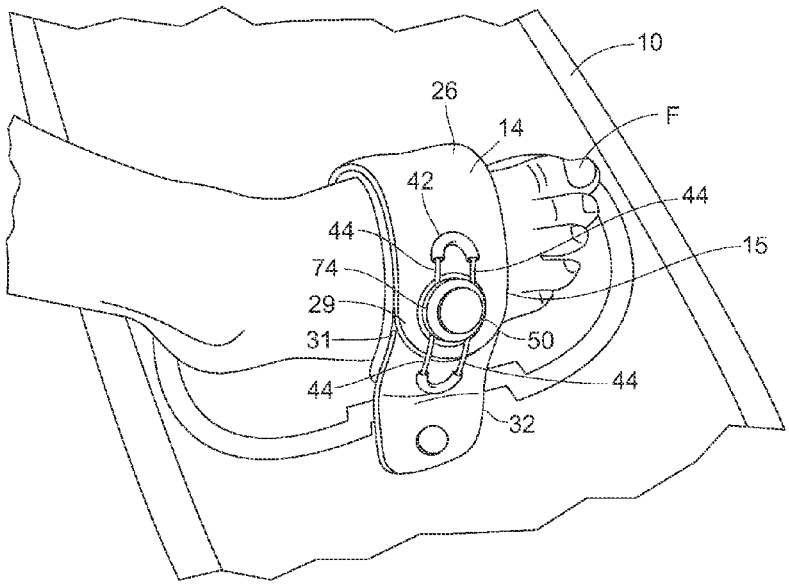
FIG. 1 is a perspective view of the binding of the present invention mounted on a kite-board with a user's foot held therein.

As seen in FIG. 1, the invention comprises a sports board 10 and a strap 14 arched over the board forming an open ended enclosure 15 for securing a foot F of a user to the sports board during use. As in normal practice, the foot F simply slips under the enclosure 15 until the foot F is snug between the strap 14 and the sports board 10. As shown, the board 10 is a kite board. However, it should be understood that the strap and cable adjuster of the present invention may be used with other sports boards that are used to secure the foot of the user to the deck of the board, such as windsurf boards, surfboards, or mountain boards.

Figure 2:
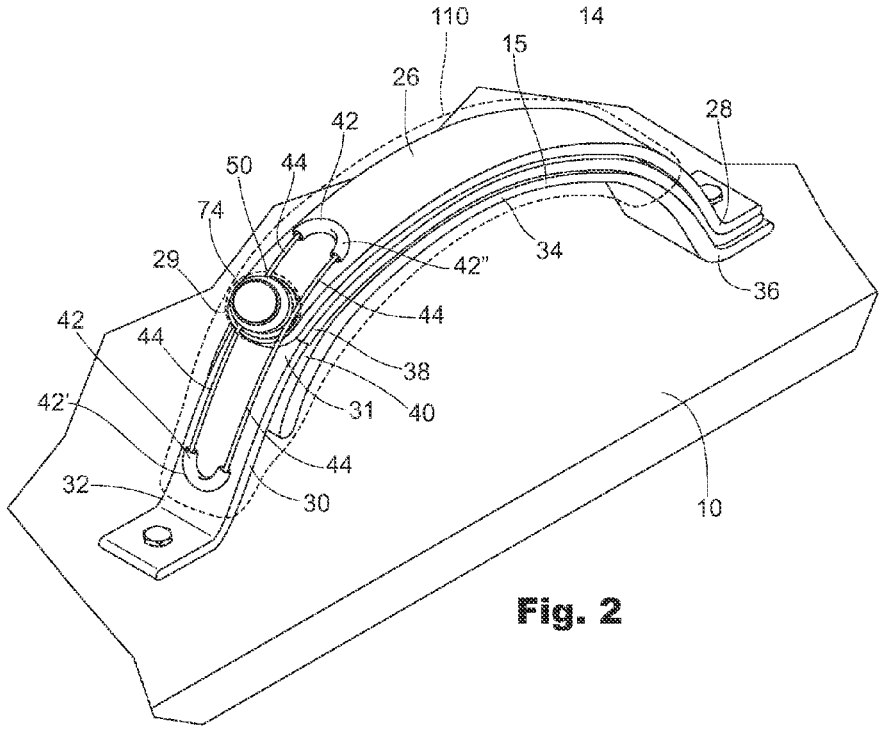
FIG. 2 is perspective view of the strap, including separate first and second strap sides, a pad and a sleeve into which the second strap side telescopes.
Figure 3:
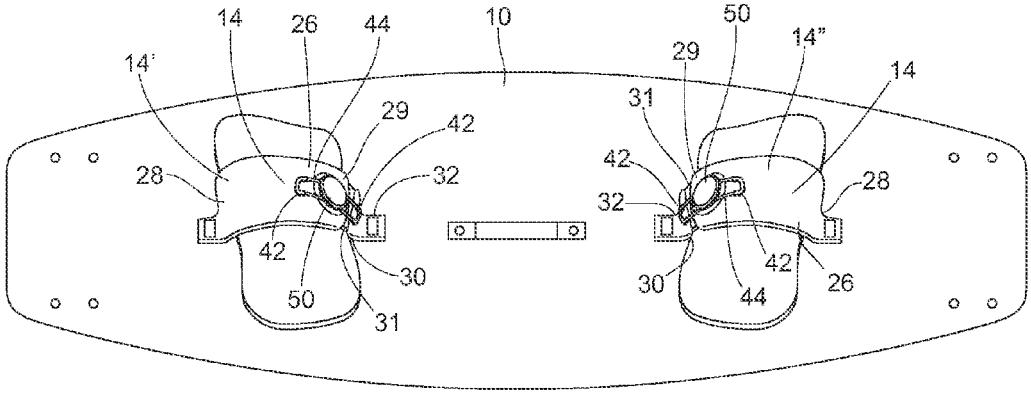
FIG. 3 is a top view of the binding/board combination showing two bindings on a board for both of a users feet.
Figure 4A:
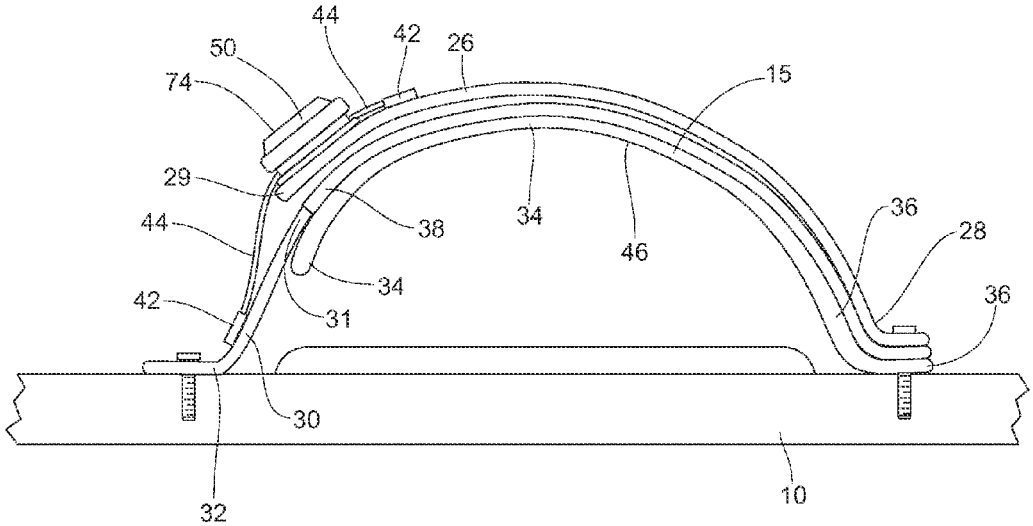
FIG. 4A is a front view of the binding of the present invention.
Figure 4B:
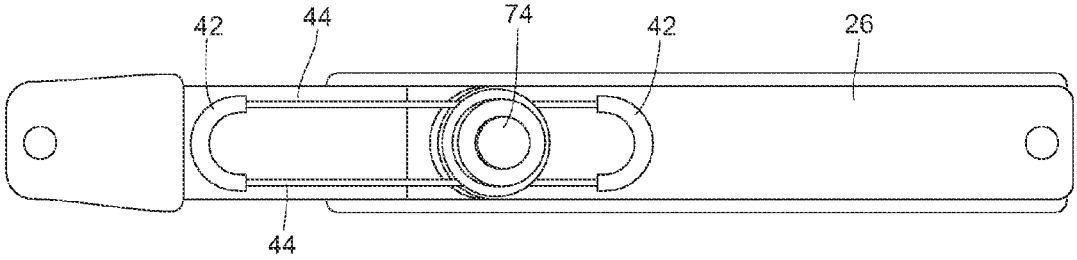
FIG. 4B is a top view of the present invention with the cable adjuster mounted on the strap first side, showing the strap first side longer than the strap second side and extending substantially over the enclosure.
Figure 5:
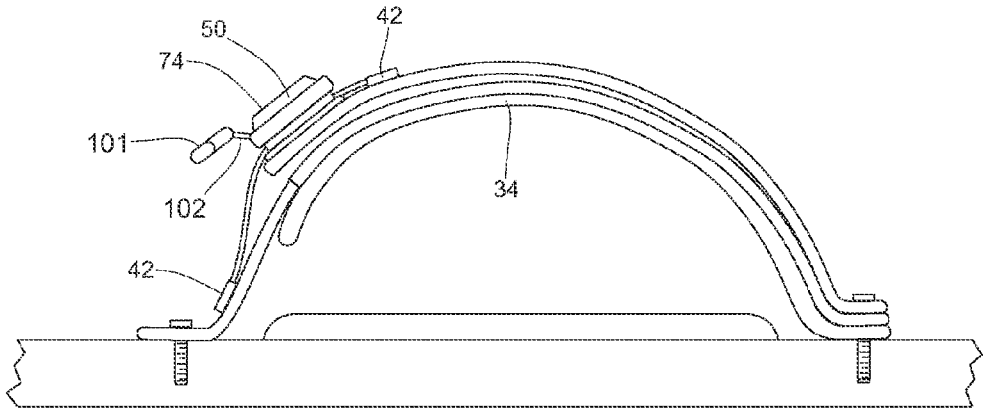
FIG. 5 is a front view of the binding mounted on the board consistent with FIG. 4.

As shown in FIG. 2 and FIG. 4, the strap 14 includes a strap first side 26 with a strap first side proximal end 28 attached to the board 10 and a strap first side distal end 29 above the board 10. A strap second side 32 includes a strap second side proximal end 32 also attached to the board 10 spaced apart from attachment of the strap first side proximal end 28 to the board 10. The strap second side 32 also has a strap second side distal end 31 above the board 10 and below the strap first side distal end 29 such that the two distal ends 29, 31 overlap. A pad 34 is provided with a pad proximal end 36 mounted with the strap first side proximal end 28 attached together to the board 10 with the pad configured to extend under the board 10. A sleeve 38 is secured to the pad top 40 into which is slidably received strap second side distal end 31 in overlap with strap first side 26. It should be understood that the sleeve 38 may equivalently be attached to the strap first end distal end 29 with like effect and function as well as and other equivalent configurations. Description and reference to one is deemed to include all others.

A cable guide 42 on strap first and second sides 26, 32 slidably engage a cable 44 between said distal ends 29, 31. Tensioning the cable 44 pulls the strap first and second distal ends closer 29, 31 into further overlap as the strap second side distal end 31 slides into the sleeve 38. Typically, to allow full adjustment, the cable guide 42' on the strap second side 32 is spaced apart from its distal end 31, even near its proximal end to allow the substantial portion of the strap second side 32 to slide into sleeve 38. The cable guide 42" on the strap first side 26 is typically on or near its distal end 29 to provide nearest proximity to the other cable guide 42'. Typically, the cable guide 42 on each side includes a channel to guide the cable 42 from one strap side back toward the other strap side. Thus, the cable guide 42 functionally has a U-shape configuration. The cable adjuster 50 may be anchored to either strap side or even to the board 10.

The pad 34 is of length shorter than strap first and second sides 26, 32 together so when they are pulled closer together into further overlap by the cable 44 between them, the pad 34 moves further under the strap second side 32. In normal configuration, the strap second side distal end 31 is partially within the sleeve 34 and the strap second side 32 is partially under the strap first side 26 such that when the cable 44 is tensioned bringing the strap first and second sides 26, 32 together into further overlap, the strap second end 31 simply slides further into the sleeve 34 and the pad 34 moves toward the strap second side proximal end 31. The pad 34 though shorter than the strap first and second sides 26, 32 together is nevertheless of length to bridge the top 46 of the enclosure 15 such that in use the foot is always snug between the pad 34 and the board 10. A sheath 110 wraps the pad and straps sides through which the cable adjuster 50 extends for access, which is useful in maintaining the strap sides 26, 32 and pad 34 aligned and together.

A cable adjuster 50 intercepts the cable 44 to adjust tension in the cable 44. Cable adjuster 50 is used to tighten the bridge 15 by reducing its effective length about the foot F and for release of tension on the foot F as desired. The cable adjuster 50 includes a rotatable reel 52 around which the cable winds. As the reel 52 rotates in a first rotation the cable 44 routed around the reel 52 tightens between the strap first and second sides 26, 32. Similarly, as the reel 52 rotates in a counter direction, the cable 44 loosens.

Figure 6:
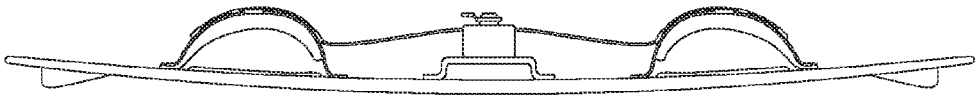
FIG. 6 is a front view of the bindings of FIG. 3.

In an alternate embodiment the cable adjuster 50 may be used to tighten two straps 14', 14" simultaneously, as illustrated in FIG. 6. In this embodiment, the cable adjuster 50 is secured to the board 10 intermediate the two straps 14', 14". The cable 44 is looped through cable guides 42 on each strap 14', 14". That is, for each strap 14, the cable passes through the cable guide 42' on one strap end and then through the cable guide 42" on the other strap end and back to the other strap where it is similarly guided and then back to the cable adjuster 50 forming a continuous loop of the cable between the two straps intercepted by the cable adjuster 50 such that tensioning of the cable 44 by the cable adjuster 42 draws the two strap sides of each of the two straps together simultaneously.

Figure 7:
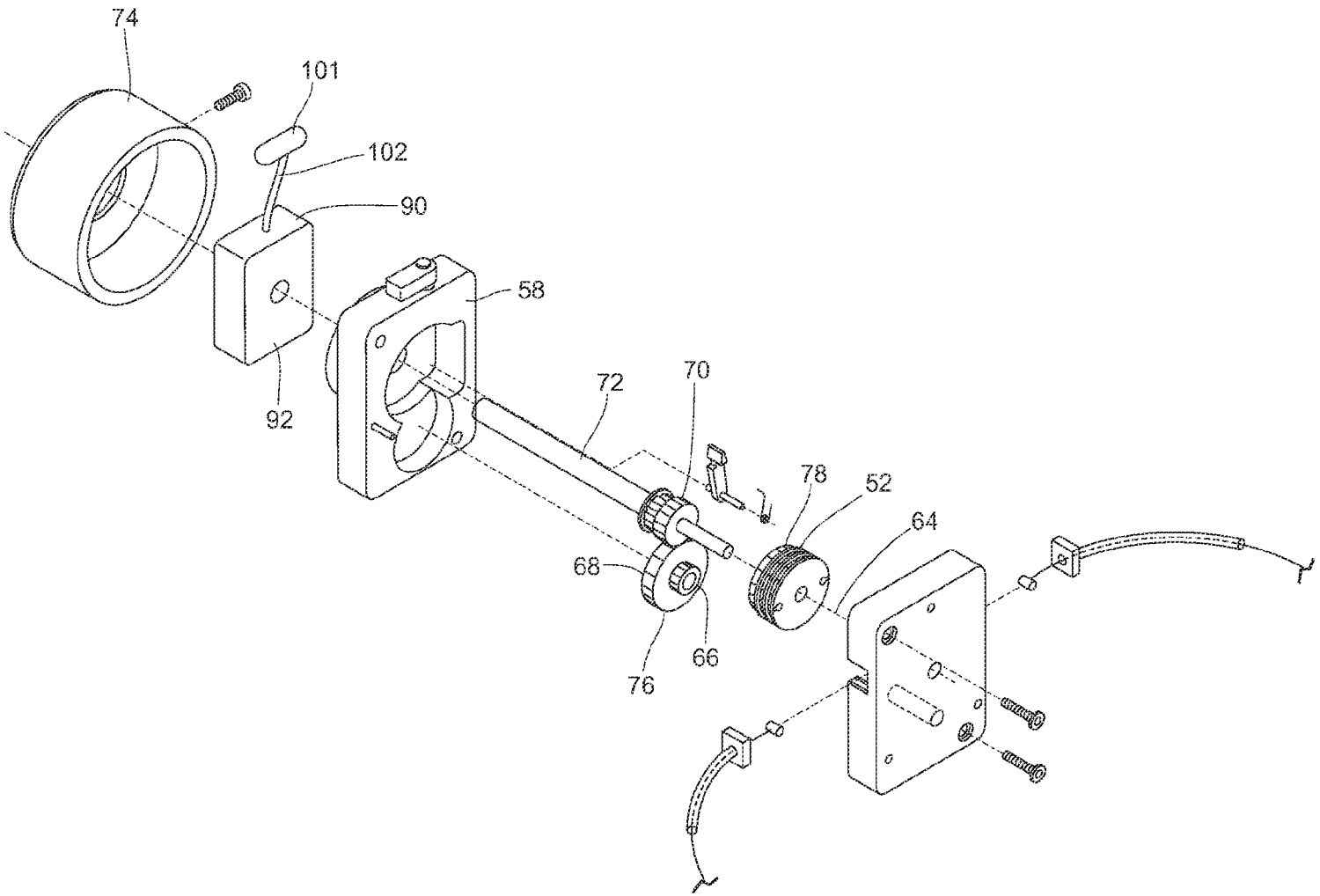
FIG. 7 exploded perspective view of the tightening components of the binding of the present invention, including a pull strap.
Figure 8:
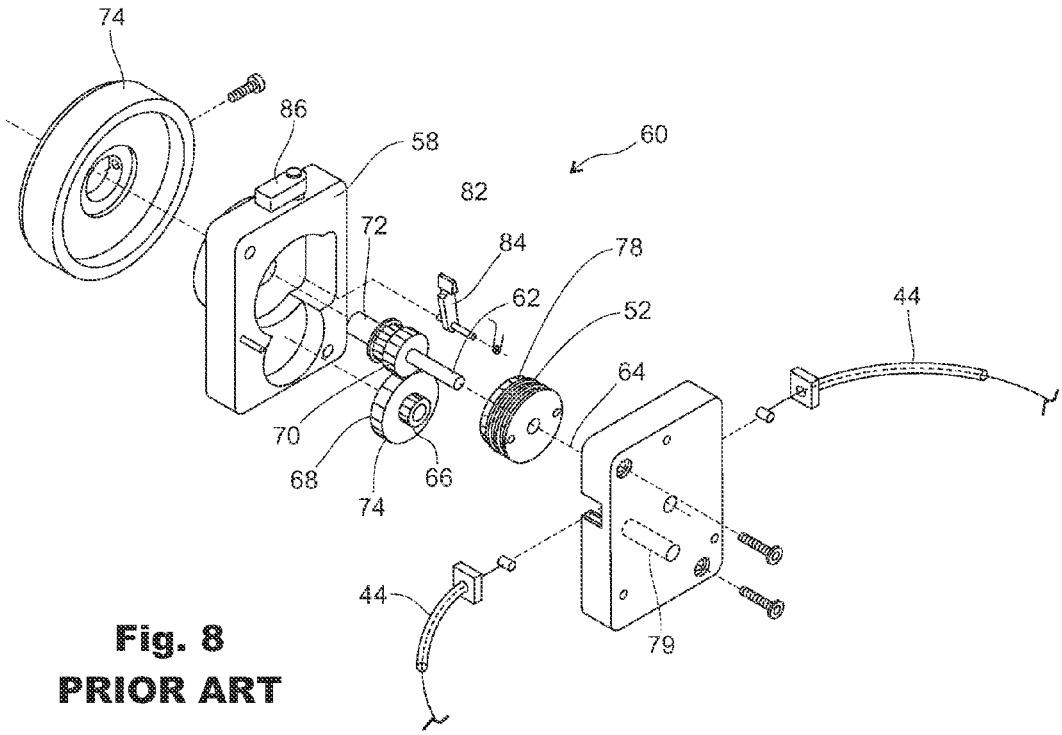
Fig. 8 PRIOR ART
FIG. 8 is an exploded perspective view of the prior art from which the binding tightening components of FIG. 7 were derived.
Figure 9:
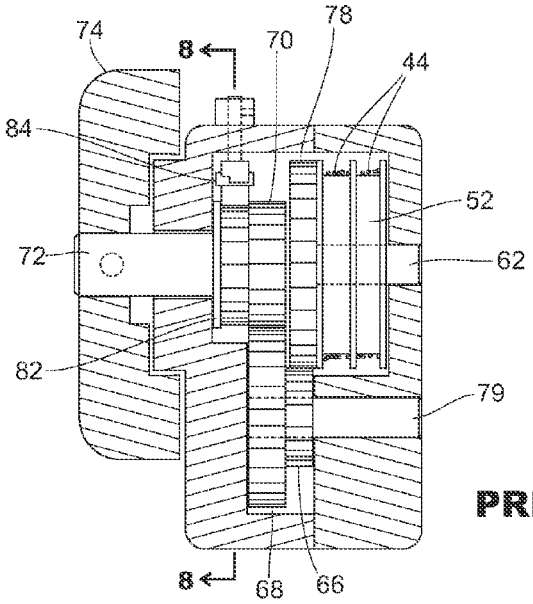
Fig. 9 PRIOR ART
FIG. 9 is a side cross-sectional view of the prior art illustrated also in FIG. 8
Figure 10:
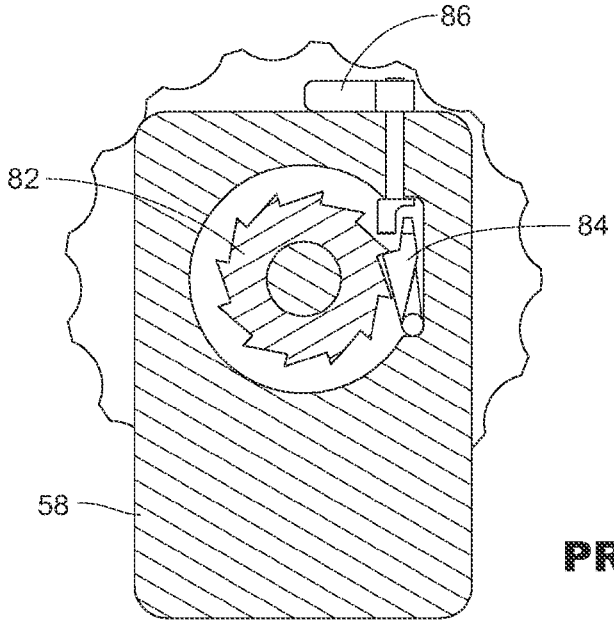
Fig. 10 PRIOR ART
FIG. 10 is a side cross-sectional view of the ratcheting mechanism of the prior art incorporated into the present invention.
Figure 11:
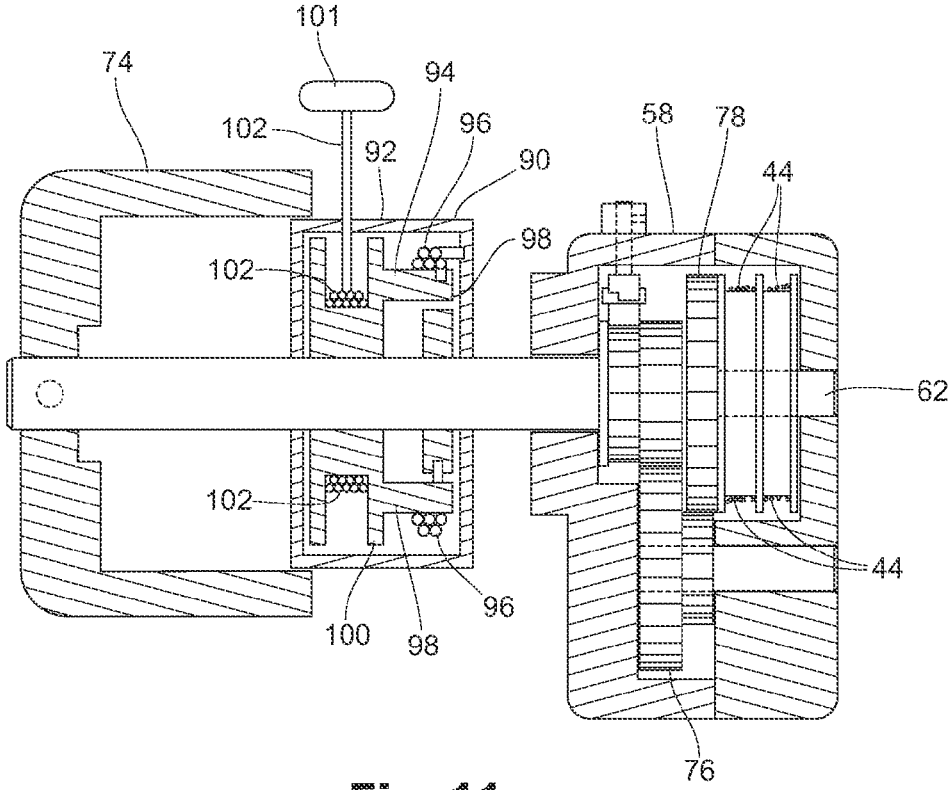
FIG. 11 is a side view of side cross-sectional view of the cable adjuster shown in FIG. 7.
Figure 12:
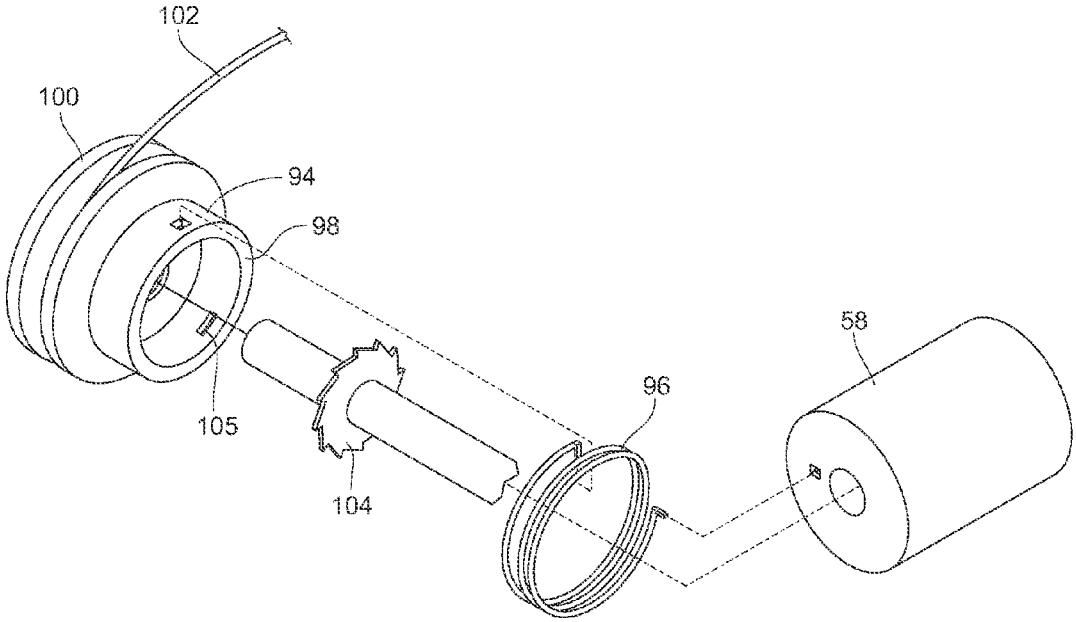
FIG. 12 is a perspective view of the pull reel and mechanism supporting the pull, incorporated into the cable adjuster of FIG. 11.
Figure 13:
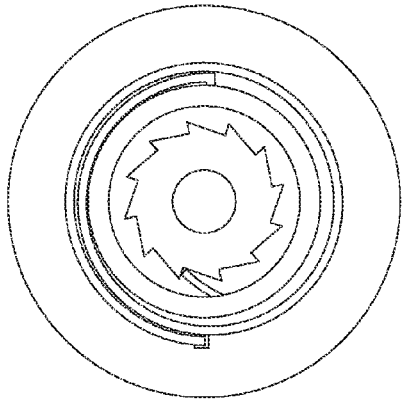
FIG. 13 is a front view of the pull of FIG. 12.

Turning now to FIG. 5 through FIG. 11, the details of the cable adjuster 50 will be described. FIGS. 6, 7, and 8 represent prior art upon which this invention builds in part, as is more fully described in U.S. Pat. No. 6,289,558 B1 by Hammerslag, which is included herein by reference. Cable adjuster 50 includes the reel 52, a housing 58, and gear assembly 60. Reel 52 holds a portion of cable 44 wound thereabout. The reel 52 is secured to and rotates about a reel shaft 62 through the reel axis 64. Drive gear 70 is secured to and rotates with a central shaft 72, which extends out of the housing 58 to a knob 74. Transfer gear 76, intermediate the drive gear 70 and a reel gear 78 that is secured to and rotates with the reel shaft 62, rotates on transfer gear shaft 79 and has a smaller gear 66 and a larger gear 68. The smaller gear 66 is configured to engage the reel gear 78 and the larger gear 68 is configured to engage drive gear 70 with the result that a mechanical advantage obtains between the knob 74 and the reel 52.

Secured to the central shaft 72 alongside the drive gear 70 is a reel ratchet sprocket 82 and a reel pawl 84 that engages and disengages from the sprocket 82 by turn of a release lever 86 outside of the housing 58, which lever 86 is mechanically linked to the reel pawl 84. In an engage position of the lever 86, the reel pawl 84 is moved to engage the reel ratchet sprocket 82 and the central shaft 72, in which case the reel ratchet sprocket 82 is allowed to rotate with the central shaft 72 in a wind rotation wherein the cable 44 winds on the reel 42 while the reel pawl 84 sliding over the sprocket 82 without engaging it but while also preventing the reel ratchet sprocket 82 from counter-rotating by the reel pawl 84 engaging the reel ratchet sprocket 82 in normal ratchet operation. With the reel pawl 84 turned to disengage position, it does not engage the reel ratchet sprocket 82 and the reel 52 is released to rotate freely with the result that tension in the cable 44 is relaxed.

It may be advantageous to provide rotation of the central shaft 72 quicker than provided with the knob 74. In which case, a pull 90 is provided. The pull 90 comprises a pull housing 92, a body 94 connected to and rotating with the central shaft 72, the body 94 comprising a coil spring 96 around a body tube 98, with one end connected to the body 94 and another end connected to the reel housing 58 or pull housing 92. The body 94 further comprises a spool 100 and a cord 102 connected between the spool 100 and a handle 101 external of the housing 92, which cord 102 wraps around the spool 100. Internal to the body tube 98 is a pull sprocket 104 and a pull pawl 105 pivoting at the tube 98 with the pull pawl 105 disposed to engage the pull sprocket 104 when the cord 102 is pulled against the bias of coil spring 96 and to release or disengage from the pull sprocket 104, sliding over the pull sprocket 104 when the cord 102 is relaxed such that as the cord 102 is pulled by the handle 101 the pull pawl 105 engages the pull sprocket 104 which in turn rotates the central shaft 72 and the drive gear 70 such that the cable 44 is wound on the reel 42. When the cord 102 is relaxed, it is withdrawn around spool 100 under action of the spring bias of coil spring 96 while the central shaft 72 does not rotate by action of the cord 102 as the reel pawl 84 engages the reel ratchet sprocket 82.

Having described the invention, what is claimed is as follows:

1. A sports board with an adjustable foot strap, comprising:

a sports board, a strap arched over the sports board forming an open ended enclosure with the sports board, adapted to releasably receive a user's foot within, the strap comprising a strap first side and a strap second side, proximal ends of each being connected spaced apart to the board with distal ends of each extending over the board from opposite sides of the enclosure together forming an arch, a cable as a tensioning member extending between the first side and the second side of said strap, wherein tensioning of said cable tends to pull said first and second sides of said strap together to compress said strap, a cable adjuster engaging said cable, movement of said cable adjuster selectively tightening or loosening said cable between said first and second sides of said strap, said cable adjuster comprising a rotatable reel onto which said cable is at least partially spooled, wherein as said strap pulls strap first and second sides together, said first side overlaps said second side together providing an uninterrupted bridge over the enclosure, a cable guide on each strap side guiding the cable into a loop, the cable adjuster intercepting the cable in the loop to pull strap sides together between the cable guides on respective strap sides, wherein the cable adjuster is on the distal end of said strap first side and the cable guide on the strap second side is near the strap second side proximal end and the sports board, adapted to pull the straps sides together in adjustable overlapping disposition as the strap second side distal end slides under the strap first side, therein maximizing a range of cable adjustment over substantially a full length of said second side, a pad attached to the board only at a pad proximal end and extending under the strap first side with a pad distal end sliding under said strap second end, the strap second side received telescopically between the pad and the strap first side, wherein the pad extends from attachment to the board to the strap distal end substantially over the enclosure such that the pad continues to bridge over the user's foot in the enclosure for comfort as the strap sides telescope to any preferred relative position, a sleeve secured to the pad between the pad and the strap first side into which sleeve said strap second side telescopes therein retaining said strap second side under said strap first side as said strap second side moves under said strap first side, a pull in combination with the cable adjuster mechanically linked to said reel causing the reel to rotate and wind the cable thereon to tighten cable tension, wherein the cable adjuster further comprises:

a reel, a housing, and a gear assembly wherein said reel holds a portion of the cable wound thereabout, the reel being secured to and rotating about a reel shaft through a reel axis, a drive gear secured to and rotating with a central shaft that extends out of the housing to a knob, a transfer gear intermediate the drive gear and a reel gear that is secured to and rotates with the reel shaft transfer gear shaft and has a smaller gear and a larger gear, the smaller gear being configured to engage the reel gear and the larger gear being configured to engage drive gear with the result that a mechanical advantage obtains between the knob and the reel, and a reel ratchet sprocket secured to the central shaft alongside the drive gear and a reel pawl that engages and disengages from the sprocket by turn of a release lever outside of the housing, which lever is mechanically linked to the reel pawl wherein in an engage position of the lever, the reel pawl is moved to engage the reel ratchet sprocket and the central shaft, in which case the reel ratchet sprocket is allowed to rotate with the central shaft in a wind rotation wherein the cable winds on the reel while the reel pawl sliding over the sprocket without engaging it but while also preventing the reel ratchet sprocket from counter-rotating by the reel pawl engaging the reel ratchet sprocket in normal ratchet operation, such that with the reel pawl turned to disengage position, it does not engage the reel ratchet sprocket and the reel is released to rotate freely with the result that tension in the cable is relaxed, said pull in combination with the cable adjuster mechanically linked to said reel through a pull housing, a body connected to and rotating with the central shaft, the body comprising a coil spring around a body tube, with one end connected to the body and another end connected to the reel housing or pull housing, the body further comprising a spool and a cord connected between the spool and a handle external of the housing, which cord wraps around the spool, a pull sprocket and a pull pawl internal to the body tube, the pull pawl pivoting at the tube with the pull pawl disposed to engage the pull sprocket when the cord is pulled against the bias of coil spring and to release or disengage from the pull sprocket, sliding over the pull sprocket when the cord is relaxed such that as the cord is pulled by the handle the pull pawl engages the pull sprocket which in turn rotates the central shaft and the drive gear such that the cable is wound on the reel, and wherein when the cord is relaxed, it is withdrawn around the spool under action of spring bias of a coil spring while the central shaft does not rotate by action of the cord as the reel pawl engages the reel ratchet sprocket such that the pull causes the reel to rotate and wind the cable thereon to tighten cable tension.

2. The sports board and strap of claim 1 wherein the cable adjuster is on the distal end of said strap first side and the cable guide on the strap second side is near the strap second side proximal end and the sports board, adapted to pull the straps sides together in adjustable overlapping disposition as the strap second side distal end slides under the strap first side, therein maximizing a range of cable adjustment over substantially a full length of said second side.

3. The sports board and strap of claim 1 further comprising a sheath around the strap first side, the sleeve, the strap second side distal end in the sleeve, and the pad maintaining vertical alignment between them.

4. The sports board and strap of claim 1 comprising two straps secured to the sports board with a single cable engaged by a single cable adjuster that is secured to the sports board, said cable looped between cable guides on both straps, which cable guides on each cable side of each respective strap disposed to pull said strap sides on said respective straps together when the cable adjuster tensions the cable therein tightening both straps simultaneously.

* * * * *